US008622389B2

(12) United States Patent
Schutzmann et al.

(10) Patent No.: US 8,622,389 B2
(45) Date of Patent: Jan. 7, 2014

(54) METHOD AND DEVICE FOR PROCESSING VALUE DOCUMENTS

(75) Inventors: Jurgen Schutzmann, Pfaffenhoffen (DE); David Sacquard, Munich (DE); Joseph Lohner, Munich (DE); Walter Berngeher, Olching (DE)

(73) Assignee: Giesecke & Devrient GmbH, Munich (DE)

( * ) Notice: Subject to any disclaimer, the term of this patent is extended or adjusted under 35 U.S.C. 154(b) by 406 days.

(21) Appl. No.: 12/999,502

(22) PCT Filed: May 20, 2009

(86) PCT No.: PCT/EP2009/003620

§ 371 (c)(1),
(2), (4) Date: Dec. 16, 2010

(87) PCT Pub. No.: WO2009/152913

PCT Pub. Date: Dec. 23, 2009

(65) Prior Publication Data

US 2011/0090546 A1 Apr. 21, 2011

(30) Foreign Application Priority Data

Jun. 18, 2008 (DE) ..... 10 2008 028 946

(51) Int. Cl.
*B65H 7/02* (2006.01)
*B65H 7/12* (2006.01)

(52) U.S. Cl.
USPC ..... 271/262; 271/263; 271/265.04

(58) Field of Classification Search
USPC ..... 271/264, 262, 263, 265.04; 194/206
See application file for complete search history.

(56) References Cited

U.S. PATENT DOCUMENTS

| | | | | |
|---|---|---|---|---|
| 4,071,233 | A | 1/1978 | Morton, Jr. | |
| 5,171,980 | A | 12/1992 | Marzullo et al. | |
| 5,368,148 | A | 11/1994 | Orlandini | |
| 5,687,963 | A | 11/1997 | Mennie | |
| 6,119,936 | A | 9/2000 | Claghorn et al. | |
| 6,600,416 | B2 | 7/2003 | Kappe et al. | |
| 2002/0033316 | A1 * | 3/2002 | Kappe et al. | 194/206 |
| 2004/0020385 | A1 | 2/2004 | Teo et al. | |
| 2007/0296202 | A1 | 12/2007 | Zwahlen | |

FOREIGN PATENT DOCUMENTS

| | | |
|---|---|---|
| DE | 19903988 | 8/2000 |
| EP | 0 559 616 A1 | 9/1993 |
| FR | 2859806 | 3/2005 |

OTHER PUBLICATIONS

Search Report of German Patent Office concerning German Patent Application No. 102008028046.9, May 5, 2009.
International Search Report in PCT/EP2009/003620, Sep. 3, 2009.

* cited by examiner

*Primary Examiner* — David H Bollinger
(74) *Attorney, Agent, or Firm* — Bacon & Thomas, PLLC

(57) ABSTRACT

The present invention relates to an apparatus for processing documents of value having a sensor device for checking the documents of value and a transport device by means of which the documents of value are transported along a transport direction past the sensor device. On a side opposing the sensor device there is disposed a guide element for passively guiding the document of value, which is moved as soon as several documents of value are transported at the same time past the sensor device. By the guide element according to the invention, documents of value can be reliably and accurately checked without great effort.

15 Claims, 5 Drawing Sheets

METHOD AND DEVICE FOR PROCESSING VALUE DOCUMENTS

BACKGROUND

1. Field

The present invention relates to an apparatus for processing documents of value, in particular bank notes, checks, vouchers, tickets, etc.

2. Related Art

From the prior art there are known apparatuses for processing documents of value, in which documents of value are transported individually one after the other by a transport device and checked with the aid of a sensor device. As a transport device there is used for example a belt transport system with several transport belts extending in parallel to each other which transport the documents of value along a transport direction past the sensor device and span a transport plane of the documents of value. The distance, which the outermost transport belts have perpendicular to the transport direction of the documents of value, defines an actively guided partial area in which the documents of value are actively guided by the transport belts and which has a certain guide width perpendicular to the transport direction. Usually, the guide width is chosen slightly smaller than the extent, perpendicular to the transport direction, of the smallest documents of value to be transported, so that the documents of value slightly project beyond the two sides of the guide area, i.e. slightly protrude beyond the outermost transport belts.

If the transport device also transports documents of value whose extent perpendicular to the transport direction is significantly greater than the guide width, these documents of value project relatively far beyond the guide area, either on one or on the two sides of the guide area. The projecting edge areas of these documents of value, thus, are not actively guided. Due to the lack of an active guiding, upon the transport of these documents of value it may occur that the edge areas of the documents of value are slightly lifted off from the transport plane or that they flutter. If the documents of value transported in this way are checked with the aid of a sensor device whose sensitivity depends on the distance of the checked documents of value, the lift-off or the fluttering of the edge areas of the documents of value may distort the measuring signal of the sensor device.

In addition, there are known various pressing devices which actively act upon the transported documents of value, for example rows of air nozzles or transport belts through which the documents of value can be pressed over a large surface against a sensor. Active pressing devices, however, require large space and their production and installation is elaborate. In particular, great effort is involved when existing apparatuses for processing documents of value are retrofitted with active pressing devices.

It is therefore an object of the present invention to provide an apparatus for processing documents of value, by which documents of value can be reliably and exactly measured without great effort.

This object is achieved by the features of the independent claims. In claims dependent thereon there are stated advantageous embodiments and developments of the invention.

BRIEF SUMMARY OF THE INVENTION

The apparatus for processing documents of value according to the invention has at least a sensor device for checking the documents of value and a transport device by means of which the documents of value are transported along a transport direction past the sensor device. The transport device is formed to actively guide a document of value transported past the sensor device, in particular a partial area of a document of value transported past the sensor device. Actively guiding the partial area means that the transport device transports the document of value by acting upon the partial area and at the same time guides the partial area of the document of value during the transport of the document of value. Guiding the document of value or the partial area means that the document of value or the partial area of the document of value, during the movement of the document of value, is influenced in its spatial position. By the guiding for example the spatial position of the document of value or of the partial area can be limited to the transport plane of the document of value.

In an exemplary embodiment, the partial areas of the documents of value are actively guided by transport belts which are moved along the sensor device and which pull along the documents of value. In another exemplary embodiment, the partial areas of the documents of value are actively guided with the aid of transport rollers, by the rotation of which the documents of value are pushed forward and transported past the sensor device. The transport device can be formed to transport the documents of value either along the longitudinal direction of the documents of value or perpendicular to the longitudinal direction of the documents of value.

The partial area in which the transport device actively guides the document of value has a certain extent perpendicular to the transport direction which is referred to as the guide width. The guide width usually is smaller than the extent of the transported document of value perpendicular to the transport direction, which in the following is referred to as the width of the document of value. For example, the guide width may amount to 80% or less of the width of the document of value. Outside the actively guided partial area there is disposed an edge area of the document of value. The edge area is located, when viewed perpendicular to the transport direction, at the edge of the document of value and is not actively guided by the transport device. Depending on the position of the actively guided partial area, outside the actively guided partial area there is either one edge area which is not actively guided or there are two edge areas which are not actively guided. The document of value, therefore, when viewed perpendicular to the transport direction, may protrude beyond either one side or beyond both sides of the transport device.

The guide element according to the invention is formed to passively guide the document of value transported past the sensor device. For example, the guide element according to the invention may be formed to passively guide substantially an edge area of the document of value transported past the sensor device, for example exactly one of the two edge areas of the document of value or both edge areas of the document of value. The edge area of the document of value lies outside the actively guided partial area, so that the transport device does not exert a force on the edge area of the document of value. During the transport of the document of value past the sensor device, the document of value, in particular the edge area of the document of value, is guided by the guide element. The guide element passively guides the document of value, in particular the edge area of the document of value. That means, the guide element reacts to a mechanical force which the document of value or the edge area of the document of value exerts on the guide element—corresponding to the physical laws of action and reaction—through an opposing force on the document of value or the edge area. But the guide element does not act, i.e. it does not exert a force on its own—i.e. no action force—on the transported document of value or on the edge area of the document of value. The guide element is not a component of the transport device. The document of value or the edge area of the document of value is passively guided by the guide element only during the document of value's transport past the sensor device. Preferably, the guide element is a passive element which cannot carry out a movement on its own, but can only be moved by the action of several documents of value transported at the same time past the sensor device.

Upon the transport past the sensor device, the document of value or the edge area of the document of value, meets the guide element so that the document of value or the edge area mechanically contacts the guide element. The guide element may be formed such that the transported document of value, in particular the edge area of the document of value, through an interaction with the guide element, in particular through the mechanical contact with the guide element, is moved towards the sensor device, i.e. in a direction extending approximately perpendicular to a transport plane of the document of value. The guide element may be formed such that the document of value, in particular the edge area of the document of value, during the transport past the sensor device, glides along the guide element. The document of value or the edge area glides in particular along a surface of the guide element which faces the document of value. Preferably, the guide element influences the transport of the document of value transported past the sensor device in such a way that the detection area of the document of value, which the sensor device detects of the document of value at a time of measurement, lies substantially in one plane. For example, at each time of measurement a line-shaped area of the document of value is detected by the sensor device, which during the detection—due to the passive guiding of the guide element—substantially lies in one plane. Thus, it can be achieved that the entirety of detection areas of the document of value, which the sensor device detects of the document of value at the various times of detection, lie substantially in one plane.

In an exemplary embodiment, the guide element exclusively guides the edge area of the document of value, i.e. exactly one edge area or both edge areas of the document of value, without acting upon the actively guided partial area of the document of value. For this purpose, the guide element may be disposed beside the transport device, i.e. perpendicular to the transport direction shifted relative to the transport device, in particular on one or on both sides beside the transport device. So as to passively guide both edge areas of the document of value, the guide element may extend for example over the entire width of the document of value, whereby, however, it passively guides the document of value only in the two edge areas outside the actively guided partial area and does not act upon the actively guided partial area that lies in between. Alternatively, the two edge areas can also be passively guided by two of the guide elements according to the invention, which each guide only one of the two edge areas.

In an alternative exemplary embodiment, the guide element can be additionally used for guiding of the document of value in the actively guided partial area of the document of value. For example, the guide element can be formed to passively guide the document of value substantially over its entire width. If the guide element guides the document of value in the actively guided partial area, it can also be disposed between the components of the transport device, e.g. between the transport belts or between the transport rollers. It is also possible to use several guide elements, at least one of them passively guiding the edge area of the document of value and at least one other effecting a passive guiding of the document of value in the actively guided partial area. The guide element can also be used for passively guiding the document of value exclusively in the actively guided partial area of the document of value.

The guide element is disposed, in relation to the transport plane of the documents of value, on the side opposing the sensor device, that is, on that side of the transported documents of value which faces away from the sensor device. On the side opposing the sensor device there can be disposed one or more guide elements which are disposed on a common shaft or which, when viewed in the transport direction, are disposed one after the other. On the side opposing the sensor device the guide element can be disposed directly opposing the sensor device, e.g. centrally opposite the center of the sensor device or shifted relative to the center of the sensor device, i.e., when viewed in the transport direction, before or after the center of the sensor device. The guide element can also be alternatively disposed, when viewed in the transport direction, directly before or directly after the sensor device. In this case, the guide element is preferably located, when viewed in the transport direction, within a distance from the sensor device, which corresponds to the length of the document of value transported past in the transport direction.

In an embodiment, the guide element is disposed directly adjacent to a component of the transport device, which is disposed opposite the sensor device and actively guides the actively guided partial area of the documents of value, e.g. directly adjacent to one or more transport belts and/or to transport rollers by which the documents of value are actively guided on the side opposing the sensor device. The documents of value are transported along the sensor device in a transport slit in which extends the transport plane of documents of value. The guide element limits for example at least partly that section of the transport slit which is effective for the edge area of the documents of value.

As soon as several documents of value are transported at the same time past the sensor device, the guide element is moved. In particular, the guide element is moved by a force directed in the transport direction, which the documents of value transported at the same time past the sensor device exert on the guide element. The guide element preferably does not perform an active movement but is passively moved. In particular, the guide element is disposed and formed such that it is moved by several documents of value transported at the same time past the sensor device. For example, the guide element does not move until at least two documents of value are transported at the same time past the sensor device. In alternative embodiments, the guide element does not move until at least three or until at least four or until a certain larger number of documents of value are transported at the same time past the sensor device or until a certain joint thickness of the documents of value transported past at the same time is exceeded. The documents of value transported past at the same time may lie completely on top of each other or may be mutually shifted, they lying at least at one point one above the other. By the movement of the guide element there is enlarged the distance between the guide element and the surface of the sensor device. Thus it is possible for the documents of value lying one above the other to be easily transported past the sensor device, i.e. without the danger of transport troubles, e.g. a transport jam of the documents of value. For example, by the movement of the guide element the transport slit between the guide element and the surface of the sensor device is enlarged, in comparison to the original height, only by approximately the thickness of the documents of value additionally transported past the sensor device. Alternatively, it is also possible that the transport slit is significantly enlarged in comparison to the original height, e.g. if a multiplicity of documents of value are transported at the same time past the sensor device or if the guide element is actively moved. If the original height is chosen to be relatively low, the transport slit may be enlarged by the movement of the guide element to a multiple of the original height.

Alternatively, the guide element can also be actively moved so as to make it possible for several documents of value lying one above the other to be transported past. For example, the active movement can be prompted by a thickness sensor or multiple pick sensor, which is disposed in the apparatus, when viewed in the transport direction, before the sensor device. This sensor sends a corresponding signal to an actuator of the guide element, which moves the guide element when several documents of value are expected at the same time at the sensor device.

Through the movement, the guide element is deflected out of a rest position of the guide element. In its rest position the guide element passively guides the documents of value or their edge areas which are (properly) individually transported past. Due to the guide element's movement out of its rest position into a deflected position, also (improperly transported) documents of value lying on top of each other can be transported without problems past the sensor device. Preferably, the movement of the guide element is counteracted by a restoring force, in particular a spring force, which brings back the guide element into the rest position after its deflection. In particular, the rest position of the guide element can be stipulated by a mechanical stop against which the guide element in its rest position is pressed or pulled, in particular by the restoring force.

The movement of the guide element is preferably a rotational movement, in particular a rotational movement around a rotation axis whose orientation is perpendicular to the transport direction of documents of value. The rotational movement in particular is caused by the force which the several transported documents of value exert on the guide element. The arrangement and the form of the guide element are chosen such that the rotational movement of the guide element effects an enlargement of the distance between the guide element and the surface of the sensor device, for example an enlargement of that section of a transport slit which is effective for the edge area of the document of value. In an exemplary embodiment, the rotation axis is disposed eccentrically to a center of the guide element, in particular in comparison to the center of a main section of the guide element shifted upwards. In this way it can be achieved that the distance between the guide element and the surface of the sensor device is automatically enlarged by the rotational movement.

Alternatively, the rotation axis of the guide element may also be disposed centrally in relation to the center of the guide element (or in relation to the center of the main section) and the form of the guide element (or of the main section) can be chosen such that the distance between the guide element and the surface of the sensor device is automatically enlarged by the rotational movement. A guide element having suitable form may have e.g. an elliptical or ellipse-like cross-section. So as to make it possible in this case that the rotational movement can automatically lead to an enlargement of the transport slit, the semimajor axis of the elliptical or ellipse-like cross section and the transport plane of the documents of value must form an acute angle whose vertex points in the transport direction.

The time period for the guide element to return into the rest position is preferably shorter than or approximately equal to the time interval of two documents of value to be transported one after the other past the sensor device. Said time period may also be slightly longer than the time interval of the documents of value, but then the guide element, after a deflection out of its rest position, is only available to a limited extent for guiding the following documents of value.

In an especial exemplary embodiment, the guide element has a main section where it is suspended, and an entrance section which is disposed, when viewed in the transport direction of the documents of value, at the beginning of the guide element. When viewed in the transport direction, the entrance section and the transport plane of the document of value form an acute angle whose vertex points in the transport direction. The length of the entrance section and the acute angle are chosen so great that the incoming document of value does not thread in or get caught at the guide element. For this reason, the distance (when viewed in the transport direction) between the beginning of the entrance section and the transport plane of the documents of value is chosen sufficiently great, it amounts to e.g. at least 2 mm, preferably at least 4 mm. The entrance section can be formed to smooth out dogears of the document of value transported past. On its side facing the document of value, the entrance section may have an even surface or a curved surface. The curved surface may have e.g. a profile changeable in the transport direction, which facilitates the smoothing out of dogears of the documents of value.

In addition, the invention relates to a method for processing a document of value by means of an apparatus according to the invention. Moreover, the invention relates to a guide module for receiving the guide element according to the invention. The guide module is intended for the incorporation in an apparatus for processing documents of value and can be formed to be fastened in the apparatus. Besides the guide element, the guide module may have a shaft at which the guide element is suspended, and a spring which exerts the restoring force so that the guide element returns into its rest position, and a holding device for receiving the shaft and the guide element, which is formed to fasten the guide module in the apparatus. The position of the holding device in the apparatus can be adjustable. The holding device, if needed, can also be spring-suspended at the apparatus.

DESCRIPTION OF THE DRAWINGS

In the following the invention is explained in more detail with reference to the following Figures.

DETAILED DESCRIPTION OF PREFERRED EMBODIMENTS OF THE INVENTION

Figure 1A:
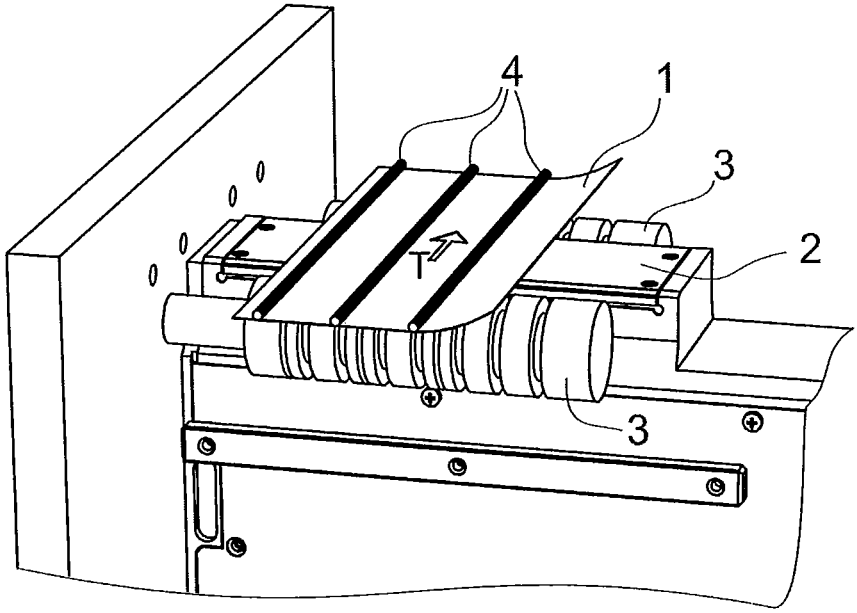
FIGS. 1*a, b* show a detail of an apparatus for processing documents of value without guide element (1*a*) or with a guide element (1*b*), FIGS. 2*a, b* show a side view of the apparatus of the FIGS. 1*a, b*, the guide element being in rest position (2*a*) or in deflected position (2*b*), FIGS. 3*a, b* show a view, directed in the transport direction, of the apparatus of FIGS. 2*a, b*, the guide element being in rest position (3*a*) or in deflected position (3*b*), FIGS. 4*a, b, c* show side views analogous to FIG. 2*a* with alternative embodiments of the guide element: a centrally suspended guide element (4*a*), a spring element (4*b*) as a guide element and a brush as a guide element (4*c*), FIGS. 5*a, b, c* show a view, directed in the transport direction, of a further exemplary embodiment with several guide elements (5*a*), a side view of a further exemplary embodiment with transport on rollers (5*b*) and a view, directed in the transport direction, of a further exemplary embodiment with a broad guide element (5*c*).

FIG. 1*a* shows a detail of an apparatus for processing documents of value 1 in which the documents of value 1 are transported along a transport direction T. In this example, the documents of value 1 are actively guided with the aid of transport belts 4 and transported past a sensor device 2 which e.g. checks the authenticity, the state or the type of the documents of value 1. The sensor device 2 can use e.g. an optical, magnetic, electrical or ultrasonic measuring principle. Opposing the transport belts 4, directly before and after the sensor device 2, there are disposed transport rollers 3 which are formed as transport rolls and against which the documents of value 1 are pressed by the transport belts 4. In the partial area 18 of the document of value 1, upon which the transport belts 4 act, the document of value 1 is actively guided by the transport belts 4 (see FIG. 3*a*). The (right) edge area 19 of the document of value 1 lies outside the transport belts 4 and is therefore not actively guided. Due to the lack of guidance, this edge area 19 may lift off from the transport plane and flutter during the transport of the document of value 1. In order for the edge area 19 of the document of value 1 to remain in the transport plane at least during the transport of the document of value 1 past the sensor device 2, opposite the sensor device 2 there is disposed a guide element 5, see FIG. 1*b*. The guide element 5 has the function to passively guide the edge area 19 of a document of value 1 during the transport past the sensor device 2. If the edge area 19, for example before the arrival at the sensor device 2, protrudes beyond the transport plane, it is guided back into the transport plane by the guide element.

Figure 1B:
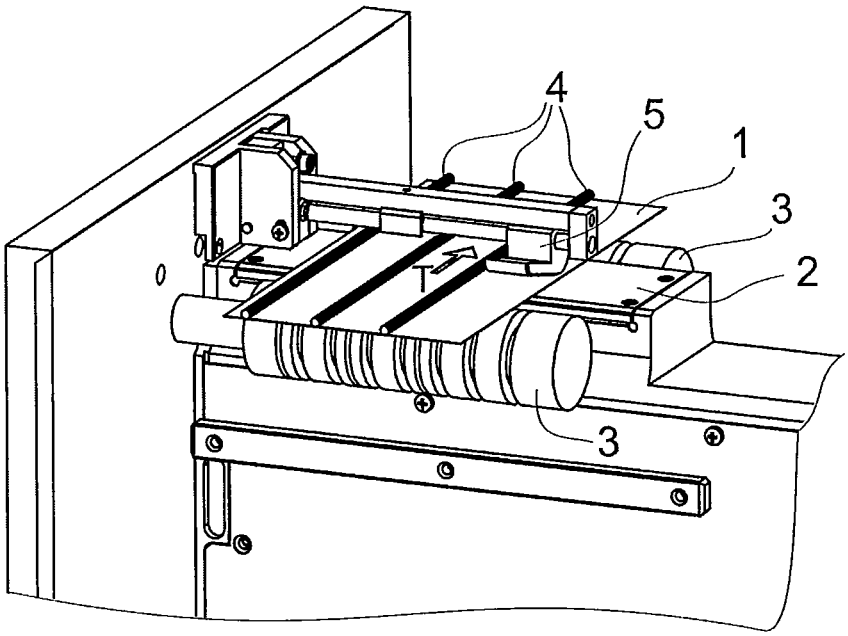
Figure 2A:
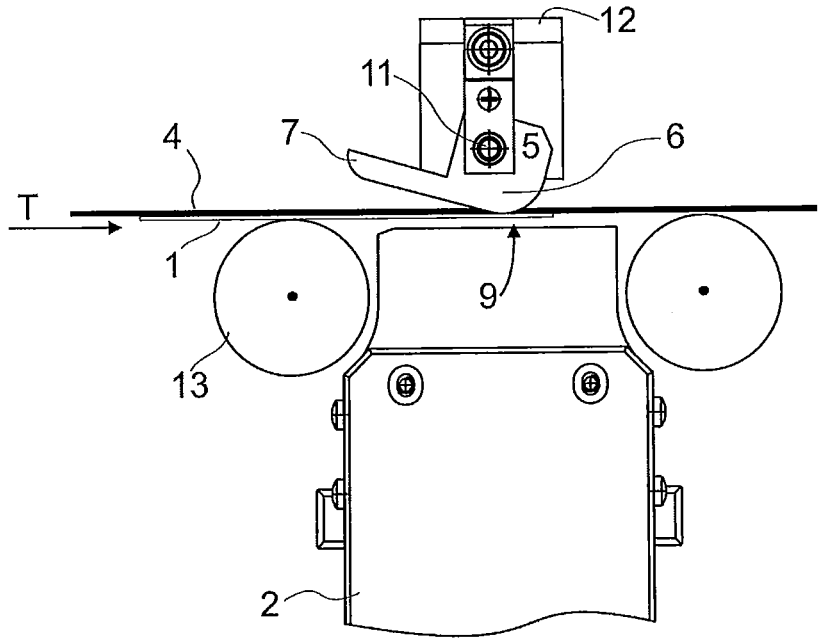

In FIG. 2*a* there is shown a side view of the arrangement of FIG. 1*b*, the document of value 1 arriving along the transport direction T in the detection area of the sensor device 2. Instead of the transport rolls 3 there are shown transport rollers 13 drawn in a simplified manner. The document of value 1 is transported in a transport slit which is formed between the surface of the sensor device 2 and the transport belts 4 or and the guide element 5, see also FIG. 3*a*. Opposing the sensor device 2 there are disposed the transport belts 4 which guide the actively guided partial area 18 of the document of value 1 from above, while the transport rollers 13 guide the actively guided partial area 18 of the document of value 1 from below. In an alternative exemplary embodiment, the document of value 1 can also be guided from both sides by transport rollers, see FIG. 5*b*. Above the transport belts 4 there is disposed the guide module which is fastened to the apparatus for processing documents of value with the aid of the holding device 12. The edge area 19 of the document of value 1 is passively guided by the guide element 5, and this only in the transport section along the transport direction T in which the document of value 1 is transported directly past the sensor device 2. The rotation axis of the guide element 5 is formed by a shaft 11 on which the guide element 5 is pivotally mounted. In FIG. 2*a* the guide element 5 is—with regard to its rotational movement—in a rest position. In the rest position, the guide element is held by a spring which holds the guide element at a mechanical stop.

Figure 3A:
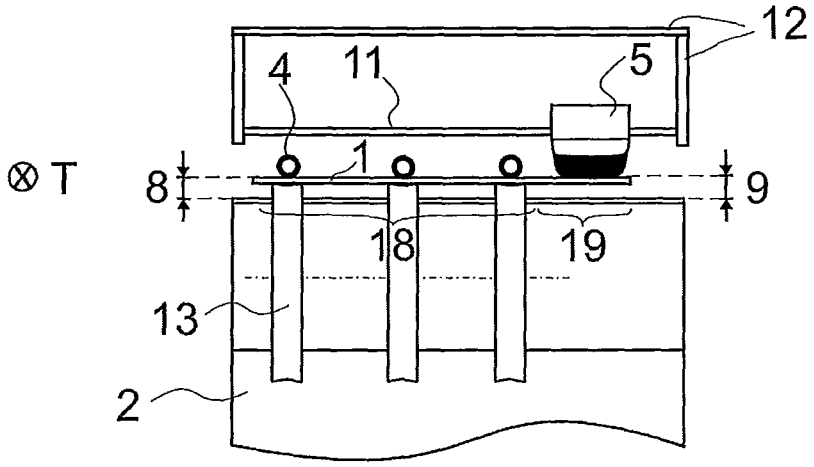

FIG. 3*a* shows a view directed in the transport direction T in which the holding device 12 of the guide element 5 is drawn only schematically and the transport rollers 13 in a simplified manner. Upon the transport past the sensor device 2, the document of value 1 is transported in a transport slit which extends between the sensor device 2 and the transport belts 4. The transport slit has a first section which is effective for the actively guided partial area 18 of the document of value 1 and which (perpendicular to the transport plane) has a first height 8 which denotes the shortest distance between the sensor device 2 and the opposing transport device (transport belts 4). The second section of the transport slit is effective for the edge area 19 of the document of value 1 and has a second height 9 which denotes the shortest distance between the guide element 5 in its rest position and the sensor device 2. The second height in the shown example is approximately equal to the first height 8, the first height 8 in this example indicating the distance of the transport belts 4 from the sensor device 2 in the case of a (properly) individually transported document of value 1. Alternatively, the second height 9 can also be slightly greater than the first height 8, so that the distance between the guide element 5 and the sensor device 2 is slightly greater than the distance between the transport belts 4 and the sensor device 2. The heights 8, 9 of the transport slit are to be chosen according to the application and e.g. depending on the type of the transport device used, the transport speed and the type and the measuring principle of the sensor device 2. The heights 8, 9 may amount to e.g. between 0.1 mm and 3 mm. Upon the transport of the document of value 1 along the sensor device 2, it may be provided that between the document of value 1 and the sensor device 2 a mechanical contact takes place. In other sensor devices 2, however, the mechanical contact is undesirable. The guide element 5 can be used in both cases. The heights 8, 9 of the transport slit are to be adjusted correspondingly.

The guide element 5 has an entrance section 7 which is disposed on that side of the guide element 5 at which the document of value 1 arrives in the detection area of the sensor device 2, see FIG. 2*a*. The edge area 19 of the document of value 1 transported past, which protrudes beyond the transport plane (upwards in FIG. 2*a*), first reaches the entrance section 7 of the guide element 5, touches the entrance section 7 (in FIG. 2*a* from below) and glides along the entrance section 7 until the guiding of the edge area 19 is taken over by the main section 6 of the guide element. During this gliding along, the edge area 19 of the document of value 1 is passively guided and moved in the direction towards the sensor device 2 (in FIG. 2 downwards). Ideally, the edge area 19 is pressed downwards by the guide element 5 that far that said edge area lies—at least in a short transport section along the transport direction T which includes the detection area of the sensor device 2—approximately in the transport plane of the document of value 1. The guide element 5 is preferably disposed at the apparatus for processing documents of value such that the shortest distance between the guide element 5 and the sensor device 2 lies in the detection area of the sensor device 2.

The entrance section 7 may serve to smooth out dogears of the document of value 1. In the shown example, the entrance section 7 is formed straight so that it provides an even surface by which the document of value 1 is passively guided. To optimize the smoothing out of dogears, the entrance section 7 can alternatively be formed in a bent fashion, so that it provides a convex surface for guiding the document of value 1. The surface of the entrance section 7 can be bent around an axis that runs approximately in parallel to the longitudinal direction of the entrance section 7. For example, the form of the entrance section 7 at the beginning of the entrance section 7 may be adapted to the form of the lifted-off edge area 19 of the document of value 1 shown in FIG. 1*a* and along the transport direction T turn into an even surface.

Figure 2B:
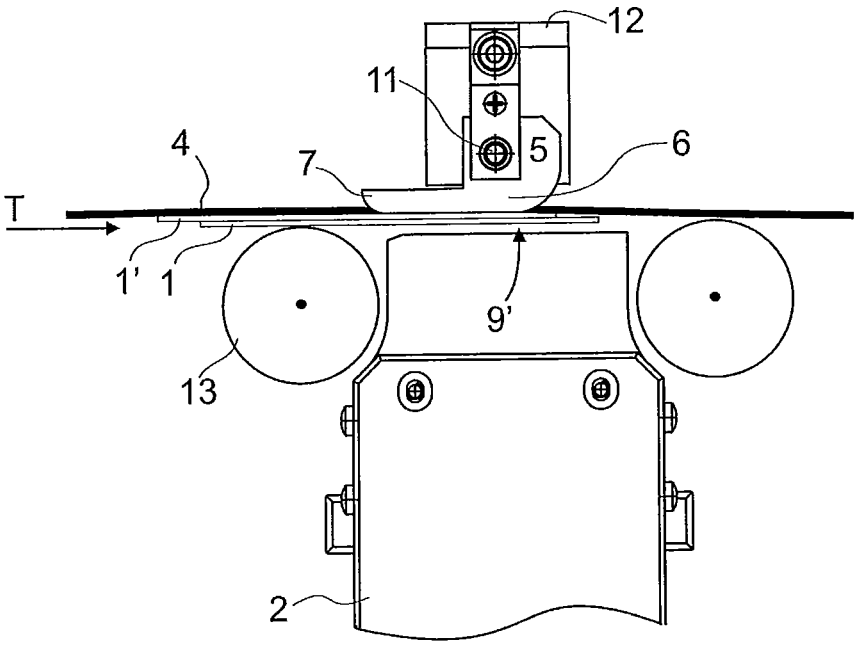
Figure 3B:
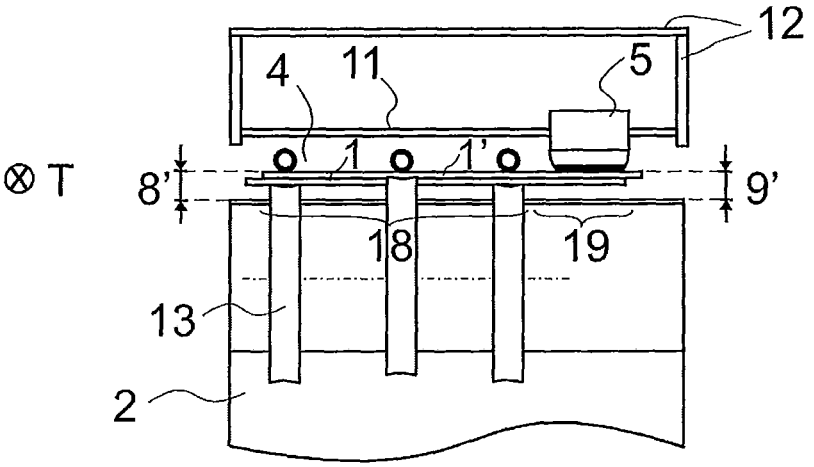

The guide element 5 is preferably disposed such that an individual document of value 1 properly transported past is passively guided, but this does not cause a movement of the guide element 5 upon the transport. Upon the transport of several documents of value 1, 1' lying one above the other at the same time, these documents can cause a movement of the guide element 5, if the joint thickness of the documents of value lying one above the other or the force, which in this case is exerted on the guide element 5, is sufficient for this. The FIGS. 2*b*, 3*b* show the guide element 5 in a deflected position into which it is rotated by the two documents of value 1, 1' transported one above the other. The rotational movement is effected against a restoring force, in particular against a spring force, which can act upon the shaft 11 of the guide element 5 and/or upon the guide element 5 itself In the shown example, the guide element 5 is firmly seated on the shaft 11 and the spring force is provided by means of a spring which is seated between the shaft 11 and the holding device 12 and which counteracts a joint rotational movement of the guide element 5 and the shaft 11. Alternatively, the guide element 5 can be mounted at the shaft 11 and the spring force be provided by a spring which is seated between the guide element 5 and the shaft 11. As a spring, in both cases, e.g. a spiral spring can be used.

In the example of the FIGS. 2*b*, 3*b*, the guide element 5 is disposed such and the spring force is set such that it performs a rotational movement as soon as at least two documents of value 1, 1' are transported at the same time past the sensor device 2. In this example, the guide element 5 is deflected that far out of the rest position by the two documents of value 1, 1', that the entrance section 7 of the guide element lies in the horizontal plane. The guide element 5, however, may alternatively also be disposed such that two documents of value 1, 1' lying one above the other lead to a minor deflection out of the rest position, and only three or four documents of value cause a full deflection of the guide element 5 in which the entrance section 7 of the guide element lies in the horizontal plane.

The shaft 11, in this example, is disposed eccentrically in relation to the center of the main section 6 of the guide element 5, i.e. the shaft 11 is not located in the center of the main section 6 of the guide element 5, but is shifted relative to it. In the example shown in FIG. 2*a*, the eccentric shaft 11 is shifted upwards and to the left compared to the center of the main section 6. The direction of the eccentricity or of the shifting of the shaft 11 is chosen such that the transport slit is enlarged by the rotational movement of the guide element 5.

By the rotational movement or the deflection of the guide element 5, the transport slit which is effective for the edge area 19 of the documents of value 1, 1' is enlarged to a height of 9'. As shown when comparing FIGS. 3*a* and 3*b*, the height 9' of the transport slit, which is stipulated by the deflected guide element 5, is slightly greater than the original height 9 which is stipulated by the guide element 5 in its rest position. For example, the height 9' is greater than the original height 9 by approximately the thickness of the document of value 1' additionally transported past the sensor device 2. With the help of the enlarged transport slit, also the documents of value 1, 1' lying one above the other can be easily transported past the sensor device 2. After the documents of value 1, 1' lying one above the other have left the area between the guide element 5 and the sensor device 2, the guide element 5 returns, due to the spring force, into its rest position (see FIG. 2*a*). In the area of the transport belts 4, the transport slit is enlarged likewise by several documents of value 1, 1' lying one above the other to form a greater height 8'. The transport belts 4, due to their elasticity and/or due to their mechanical suspension within the apparatus, can be deflected or stretched without problems corresponding to the joint thickness of the documents of value 1, 1'.

Figure 4A:
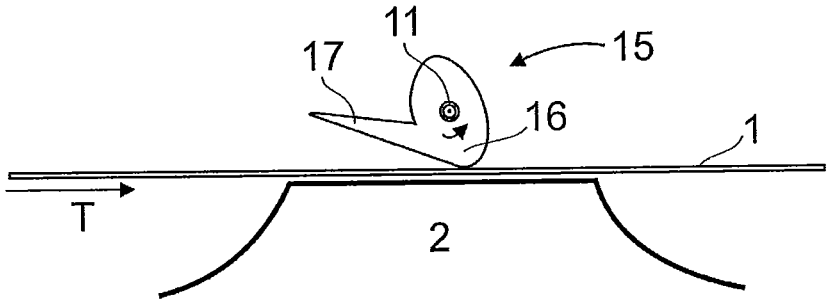

FIG. 4*a* schematically shows a side view analogous to FIG. 2*a* of a further exemplary embodiment, in which there is employed, as an alternative to the guide element 5, a guide element 15. The guide element 15 is used for passively guiding a document of value 1 which is transported in the transport direction T past the sensor device 2. The guide element 15 has an entrance section 17 and an ellipsoidal main section 16. The shaft 11 to which the guide element 15 is pivotally fastened is disposed centrally relative to the center of the main section 16. Upon the transport of several documents of value 1, 1' at the same time, the guide element 15 rotates against a spring force in the way indicated by the arrow relative to the shaft 11, so that the transport slit for the documents of value 1, 1' is enlarged.

Figure 4B:
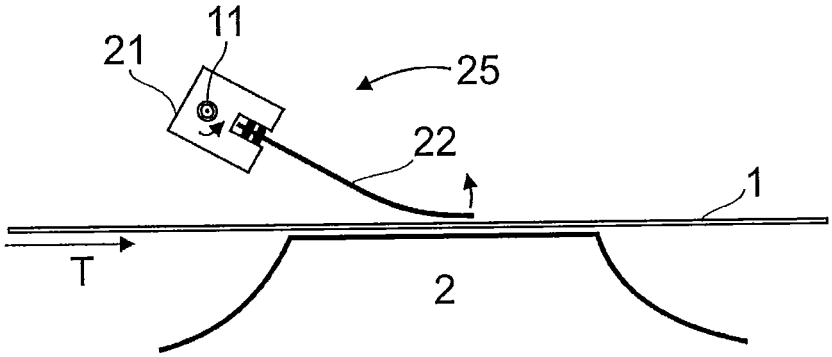

Alternatively, there can also be employed guide elements which are elastically deformable. For the passive guiding of the document of value 1 there can be used, for example, a guide element 25 which has a spring element 22 which with one of its ends is fixed in a holding device 21. The spring element 22 forms to the transport direction T of the document of value an acute angle whose vertex points in the transport direction T. The holding device 21 is pivotally mounted on a shaft 11, analogous to the guide elements 5, 15. Upon the transport of several documents of value 1, 1' at the same time, the spring element 22 elastically springs away approximately perpendicular to the transport plane. At the same time, the guide element 25 is prompted by the documents of value 1, 1' to perform a rotational movement around the shaft 11, so that the transport slit effective for the documents of value 1, 1' is enlarged, see FIG. 4*b*. The spring stiffness of the spring element 22, in comparison to the spring force which counteracts the rotational movement, can be chosen differently as needed. Thus, the enlargement of the transport slit can be caused for example mainly by the rotational movement or mainly by the spring element 22 springing away or by both.

Figure 4C:
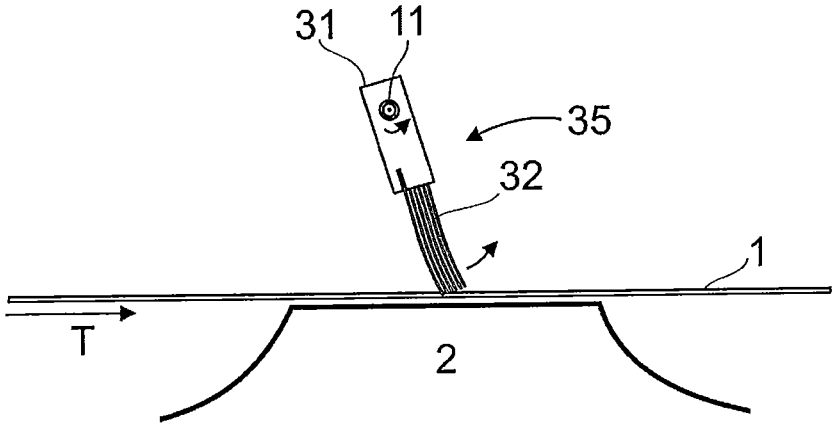

In another exemplary embodiment, for the passive guiding of the document of value 1 a brush element is used as a guide element 35, see FIG. 4*c*. Upon the transport of several documents of value 1, 1' at the same time, the documents of value 1, 1' elastically press the flexible bristles 32 of the brush element out of the transport plane, so that the transport slit effective for the documents of value 1, 1' is enlarged. At the same time, also the guide element 35 is prompted by the documents of value 1, 1' to perform a rotational movement around the shaft 11, so that the transport slit effective for the documents of value 1, 1' is enlarged, see FIG. 4*c*. Analogous to the example of FIG. 4*b*, here, too, the stiffness of the bristles 32, in comparison to the spring force which counteracts the rotational movement, can be chosen differently as needed. The bristles 32 of the brush element are fastened in a holding device 31 and can be disposed approximately perpendicular to the transport plane or form an acute angle to the transport plane of the document of value, whose vertex points in the transport direction T. Because of their elasticity, the spring element 22 and the bristles 32 move back to their rest position after several documents of value have been transported past at the same time, so that the guide element 25 or 35 again is available for the passive guiding of the following documents of value.

Figure 5A:
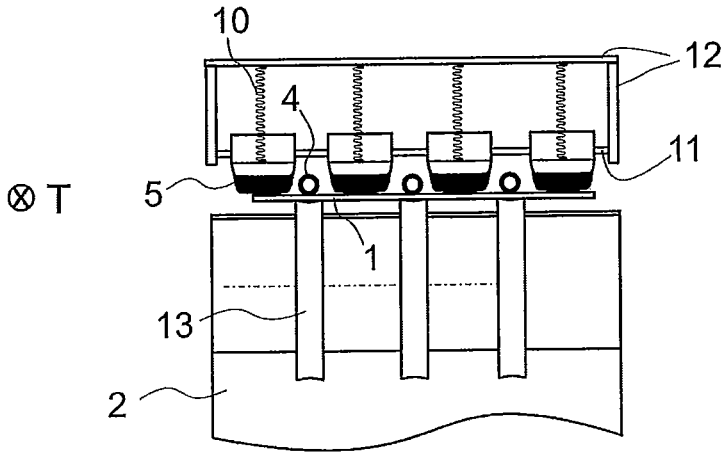

FIG. 5*a* shows a further exemplary embodiment, which for the passive guiding of the document of value 1 uses several guide elements 5 which are mounted at a common shaft 11. The spring force which brings back the guide elements 5 into their rest position in this example is provided through linear springs 10, e.g. coil springs. In their rest position, the guide elements 5 are pulled by the linear springs 10 to a stop. In the shown example, each guide element 5 is individually spring-mounted, each of the springs 10 being fastened to the holding device 12 and acting upon the entrance section 7 of a guide element 5 in each case, see also FIG. 5*b*. Instead of the linear springs 10, for the individual suspension of the guide elements 5 there can also be used a spiral spring in each case, which is seated between the guide element 5 and the shaft 11. Alternatively, the several guide elements 5 can also be disposed firmly on the shaft 11 and the shaft 11 be spring-mounted against the holding device 12, see example of FIGS. 2*a*, 3*a*.

Figure 5B:
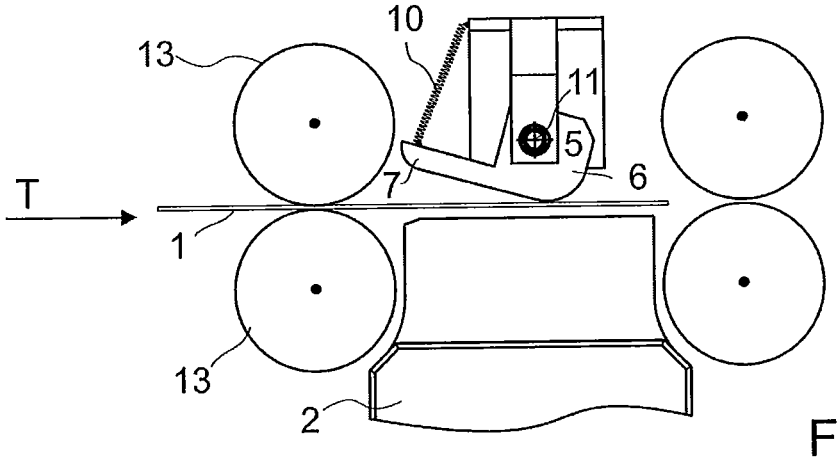

In FIG. 5*b* there is shown a side view of a further exemplary embodiment in which the documents of value are not transported with transport belts but exclusively with mutually opposing transport rollers 13 past the sensor device 2, which actively guide the documents of value on both sides. For example, the document of value 1, analogous to the example of FIGS. 3*a, b*, is actively guided in a partial area 18. For guiding the not actively guided edge area 19 of the document of value 1, a guide element 5 is used which is mounted on the shaft 11 and whose rotational movement, analogous to the example of FIG. 5*a*, is counteracted by a linear spring 10.

Figure 5C:
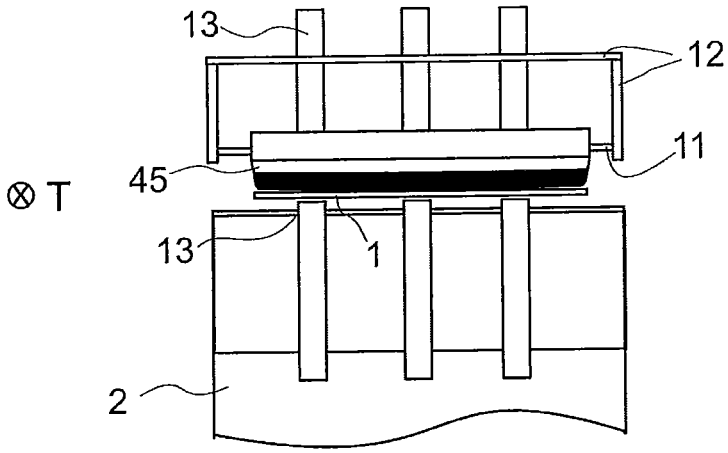

In FIG. 5*c*, there is shown a further exemplary embodiment in which opposite the sensor device 2 there is disposed a guide element 45 which is formed analogous to the guide element 5 and is spring-mounted, but has a substantially greater width. For example, substantially the entire width of the document of value 1 is passively guided by the guide element 45. Before and after the sensor device 2 there are disposed transport rollers 13, which actively guide the document of value 1 on both sides, of which, however, only the lower front and the upper rear transport rollers 13 are drawn in the Figures.

Altogether, the listed examples show only a selection of possible combinations according to the invention. The shown possibilities of design, width, number and arrangement of the guide elements as well as their spring-mounting and the various transport devices can be combined with each other in any way, depending on the requirements of the application.

We claim:

1. An apparatus for processing documents of value comprising:

a sensor device configured to check documents of value transported past the sensor device, a transport device arranged to transport and actively guide documents of value along a transport direction past the sensor device, and a guide element on a side opposing the sensor device arranged to passively guide a document of value, said guide element being movable and arranged such that the guide element does not move until at least two documents of value are transported at the same time past the sensor device.

2. The apparatus according to claim 1, wherein the guide element is arranged to be moved by the transport of several of the documents of value at the same time past the sensor device by a force exerted on the guide element and directed in the transport direction by documents of value as they are transported at the same time past the sensor device.

3. The apparatus according to claim 1, wherein the guide element is arranged to be deflected out of a rest position by several documents of value transported at the same time past the sensor device.

4. The apparatus according to claim 1, wherein movement of the guide element when several documents of value are transported at the same time past the sensor device is counteracted by a restoring force.

5. The apparatus according to claim 1, wherein movement of the guide element when several documents of value are transported at the same time past the sensor device is a rotational movement around a rotation axis whose orientation is laterally perpendicular to the transport direction of the several documents of value.

6. The apparatus according to claim 1, wherein the transport. device is arranged to actively guide a partial area of a document of value transported past the sensor device and the guide element is arranged to passively guide an edge area of the transported document of value which is disposed outside an actively guided partial area of the document of value.

7. The apparatus according to claim 6, wherein the guide element is arranged such that the edge area of the document of value is moved towards the sensor device through an interaction with the guide element.

8. The apparatus according to claim 6, wherein the guide element is arranged to passively guide substantially the edge area of a transported document of value.

9. The apparatus according to claim 6, wherein the guide element passively guides a document of value in the actively guided partial area of a document of value, said guide element being configured to passively guide a document of value substantially over its entire width.

10. The apparatus according to claim 1, wherein the guide element is disposed beside the transport device.

11. The apparatus according to claim 1, wherein the guide element guides the transport of a document of value such that a detection area of a document of value, which the sensor device detects on a document of value at a time of checking, lies substantially in one plane.

12. The apparatus according to claim 1, wherein the guide element has an entrance section which, when viewed in the transport direction of a document of value, is disposed at the beginning of the guide element, the entrance section forming an acute angle relative to a transport plane of a document of value.

13. A guide element for guiding documents of value, said guide element being configured to be used in an apparatus according to claim 1, wherein the guide element, when used in the apparatus, is configured to passively guide a document of value transported past the sensor device, and said guide element is movable and arranged such that the guide element does not move until at least two documents of value are transported at the same time past the sensor device.

14. A guide module comprising a guide element, said guide module being configured to be used in an apparatus according to claim 1, wherein when said guide module is used in the apparatus, said guide element is arranged to passively guide a document of value past a sensor device and said guide element being movable and arranged such that the guide element does not move until at least two documents of value are transported at the same time past the sensor device.

15. A method for processing a document of value, comprising: processing a document of value by an apparatus according to claim 1, wherein said processing comprises transporting a document of value past the sensor device and passively guiding the document of value by the guide element, wherein said guide element is movable and arranged such that the guide element does not move until at least two documents of value are transported at the same time past the sensor device.

* * * * *